US009303377B2

(12) United States Patent
May et al.

(10) Patent No.: US 9,303,377 B2
(45) Date of Patent: Apr. 5, 2016

(54) SNOW WING HARD LINK WITH ADJUSTABLE FLOAT CAPABILITY

(71) Applicant: Caterpillar Inc., Peoria, IL (US)

(72) Inventors: Michael Paul May, Wamego, KS (US); Ryan P. Shea, Wamego, KS (US); Bart A. Fisher, Roanoke, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/252,366

(22) Filed: Apr. 14, 2014

(65) Prior Publication Data

US 2015/0292171 A1 Oct. 15, 2015

(51) Int. Cl.
*E01H 5/06* (2006.01)

(52) U.S. Cl.
CPC ..... *E01H 5/067* (2013.01); *E01H 5/061* (2013.01)

(58) Field of Classification Search
USPC ..... 37/232, 279
IPC ..... E01H 5/066,5/067
See application file for complete search history.

(56) References Cited

U.S. PATENT DOCUMENTS

| | | | | |
|---|---|---|---|---|
| 1,529,678 | A | 3/1925 | Webb | |
| 2,029,545 | A * | 2/1936 | Ross | 37/232 |
| 2,565,337 | A * | 8/1951 | Allan | 172/817 |
| 3,032,903 | A * | 5/1962 | Ede | 37/370 |
| 3,483,642 | A * | 12/1969 | Glesmann | 37/232 |
| 4,096,652 | A * | 6/1978 | Raines et al. | 37/231 |
| 4,837,951 | A | 6/1989 | Verseef | |
| 5,044,098 | A * | 9/1991 | Berghefer | 37/232 |
| 5,177,887 | A | 1/1993 | McGugan et al. | |
| 6,070,343 | A * | 6/2000 | Sheldon | 37/267 |
| 6,073,371 | A * | 6/2000 | Goos et al. | 37/232 |
| 7,523,569 | B2 | 4/2009 | Savard | |
| 7,565,756 | B2 * | 7/2009 | Almadani | 37/232 |
| 2013/0160333 | A1 * | 6/2013 | Becicka et al. | 37/231 |

FOREIGN PATENT DOCUMENTS

| | | | |
|---|---|---|---|
| JP | 57119027 | A | 7/1982 |
| JP | 2007270530 | A | 10/2007 |

* cited by examiner

*Primary Examiner* — Gary Hartmann
(74) *Attorney, Agent, or Firm* — Miller, Matthias & Hull LLP

(57) ABSTRACT

A hard link, which is connected to a moldboard of a machine, includes a first range of float capability and a second range of float capability. The second range of float capability may provide a greater float height to the moldboard than the first range of float capability. In another embodiment, a machine includes a moldboard, a jib arm operatively configured to raise and lower the moldboard, and a link attaching the jib arm to the moldboard. The link includes two discrete float capabilities.

7 Claims, 19 Drawing Sheets

SNOW WING HARD LINK WITH ADJUSTABLE FLOAT CAPABILITY

FIELD OF THE DISCLOSURE

The present disclosure relates generally to machines and, more particularly, to systems and methods for providing float capability to a moldboard of a machine.

BACKGROUND OF THE DISCLOSURE

Machines, such as motor graders or trucks, may have a moldboard or snow wing attached to one side in order to remove snow or other materials from pavement. The snow wing may be affixed to the machine permanently or for seasonal use only. Various mounting arrangements have been used to support such snow wings. In particular, the mounting arrangements may include arms, hydraulic cylinders, and pivoting mechanisms to maintain the snow wing at a certain position and also to adjust the snow wing to different positions.

During operation, the snow wing may strike hard objects or encounter obstacles, such as a rock frozen in the roadside. These large sudden forces exerted on the snow wing can be detrimental to the machine, road, or snow wing, and may be uncomfortable for the operator. Therefore, it may be necessary to equip the snow wing with float capability, or a reacting capability for the snow wing moldboard to rapidly move upward when sudden obstacles are encountered. Float capability allows snow wings to float over the hard objects immediately after they are struck.

It is known to equip snow wings with float capability. For example, U.S. Pat. No. 5,177,877, entitled, "Snow Wing," describes such a support arrangement. The support arrangement of the '877 patent includes a pivoting link that can move outwardly a limited extent to accommodate limited rapid upward movement of the blade or snow wing. Once the blade has stepped over the article, the pivoting link of the '877 patent moves inwardly and returns to the operating position. The pivoting link of the '877 patent only provides the snow wing with one range of motion for the float capability, which is limited to the dimensions of the single extended position of the pivoting link.

It should be appreciated that the solution of any particular problem is not a limitation on the scope of this disclosure or of the attached claims except to the extent expressly noted herein. Additionally, this background section discusses problems and solutions noted by the inventors; the inclusion of any problem or solution in this section is not an indication that the problem or solution represents known prior art except that that the contents of the indicated patent represent a publication. With respect to the identified patent, the foregoing summary thereof is not intended to alter or supplement the prior art document itself; any discrepancy or difference should be resolved by reference to the document itself.

SUMMARY OF THE DISCLOSURE

According to one embodiment, a hard link may be connected to a moldboard of a machine. The hard link may include a first range of float capability, and a second range of float capability. The second range of float capability may provide a greater float height to the moldboard than the first range of float capability.

According to another embodiment, a machine may include a moldboard, a jib arm operatively configured to raise and lower the moldboard, and a link attaching the jib arm to the moldboard. The link may include two discrete float capabilities.

According to yet another embodiment, a moldboard assembly may include a moldboard, a jib arm operatively configured to raise and lower the moldboard, and a link attaching the jib arm to the moldboard. The link may include an outer cylinder operatively coupled to the jib arm, and an inner cylinder operatively coupled to the moldboard. The inner cylinder may include a first pair of slots aligned with a first pair of holes in the outer cylinder, and a second pair of slots aligned with a second pair of holes in the outer cylinder. The second pair of slots may have a greater length than a length of the first pair of slots. The link may further include a fastener configured to connect the outer cylinder to the inner cylinder when disposed through either the first pair of slots and the first pair of holes or the second pair of slots and the second pair of holes.

These and other aspects and features will become more readily apparent upon reading the following detailed description taken in conjunction with the accompanying drawings. In addition, although various features are disclosed in relation to specific exemplary embodiments, it is understood that the various features may be combined with each other, or used alone, with any of the various exemplary embodiments without departing from the scope of the disclosure.

While the present disclosure is susceptible to various modifications and alternative constructions, certain illustrative embodiments thereof will be shown and described below in detail. The disclosure is not limited to the specific embodiments disclosed, but instead includes all modifications, alternative constructions, and equivalents thereof.

DETAILED DESCRIPTION

The present disclosure provides an apparatus and method for providing multiple, adjustable float capabilities to a moldboard hard linked to a machine. In so doing, when a machine equipped with a moldboard, such as a snow plow or wing, encounters obstacles, such as, hard objects and frozen rocks in a ground surface, the moldboard can float over the obstacle to the extent necessary. In particular, the system and method provide more than one range of upward motion to the moldboard through a convenient and user-friendly configuration. By providing the moldboard with adjustable float capabilities, the machine may be used to remove snow or other materials over varying terrain applications. For example, a limited range of upward motion or float capability may be necessary for blading flat ground surfaces, while an extended range of upward motion or float capability may be necessary for removal of material over uneven ground surfaces having ditches or mounds.

Reference will now be made in detail to specific embodiments or features, examples of which are illustrated in the accompanying drawings. Generally, corresponding reference numbers will be used throughout the drawings to refer to the same or corresponding parts.

Figure 1:
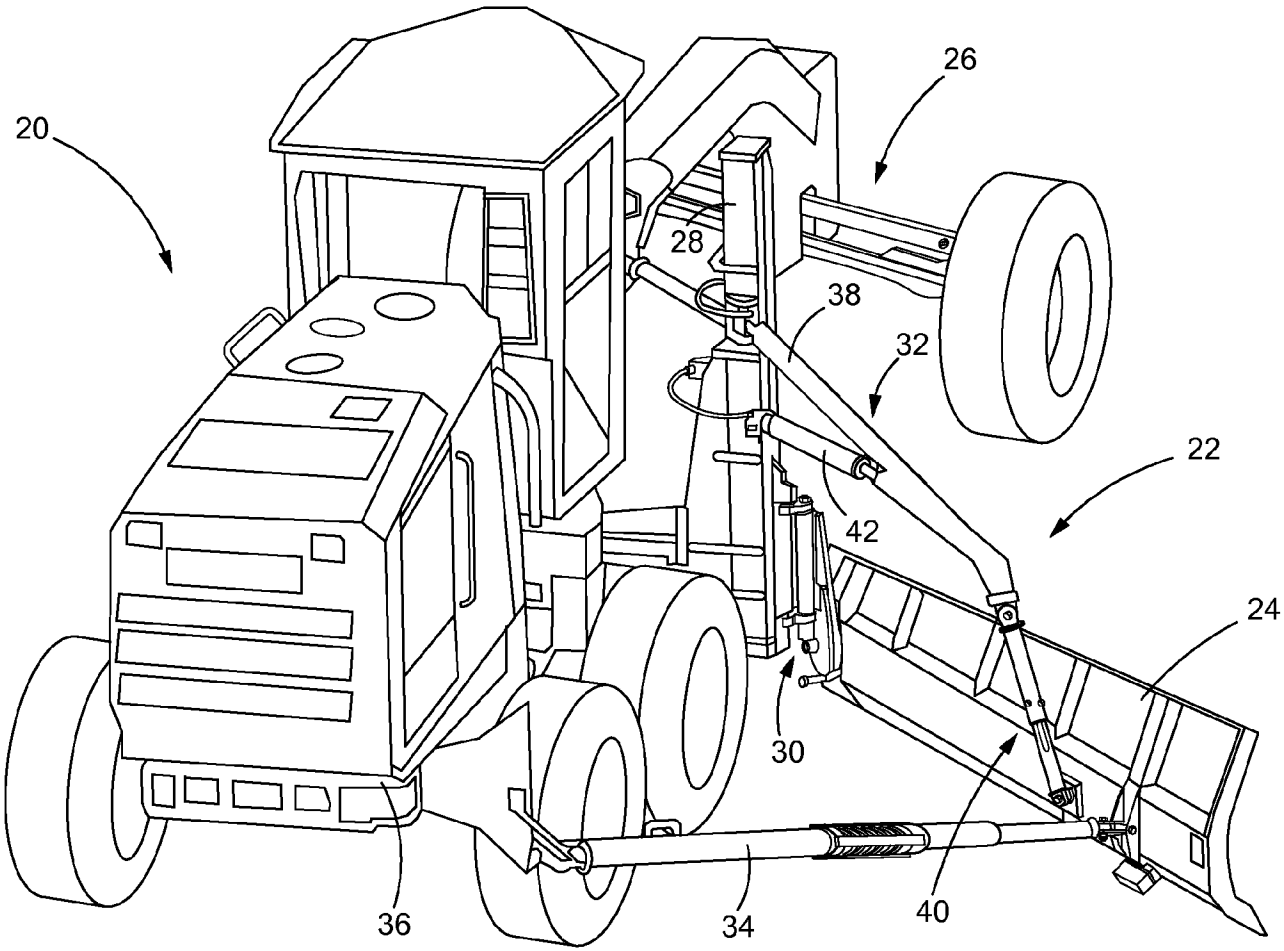
FIG. 1 is a perspective view of a machine according to one embodiment.

FIG. 1 illustrates an exemplary machine 20 consistent with certain embodiments of the present disclosure. It is to be understood that although the machine 20 is illustrated as a motor grader, the machine may be of any other type. As used herein, the term "machine" refers to a mobile machine that performs a driven operation involving physical movement associated with a particular industry, such as, without limitation, landscaping, mining, construction, agriculture, transportation, etc.

Non-limiting examples of machines include commercial and industrial machines, such as trucks, motor graders, earth-moving vehicles, mining vehicles, backhoes, material handling equipment, agricultural equipment, marine vessels, on-highway vehicles, or other types of machines that operate in a work environment. It is also to be understood that the machine 20 is shown primarily for illustrative purposes to assist in disclosing features of various embodiments, and that FIG. 1 does not depict all of the components of an exemplary machine.

Figure 2:
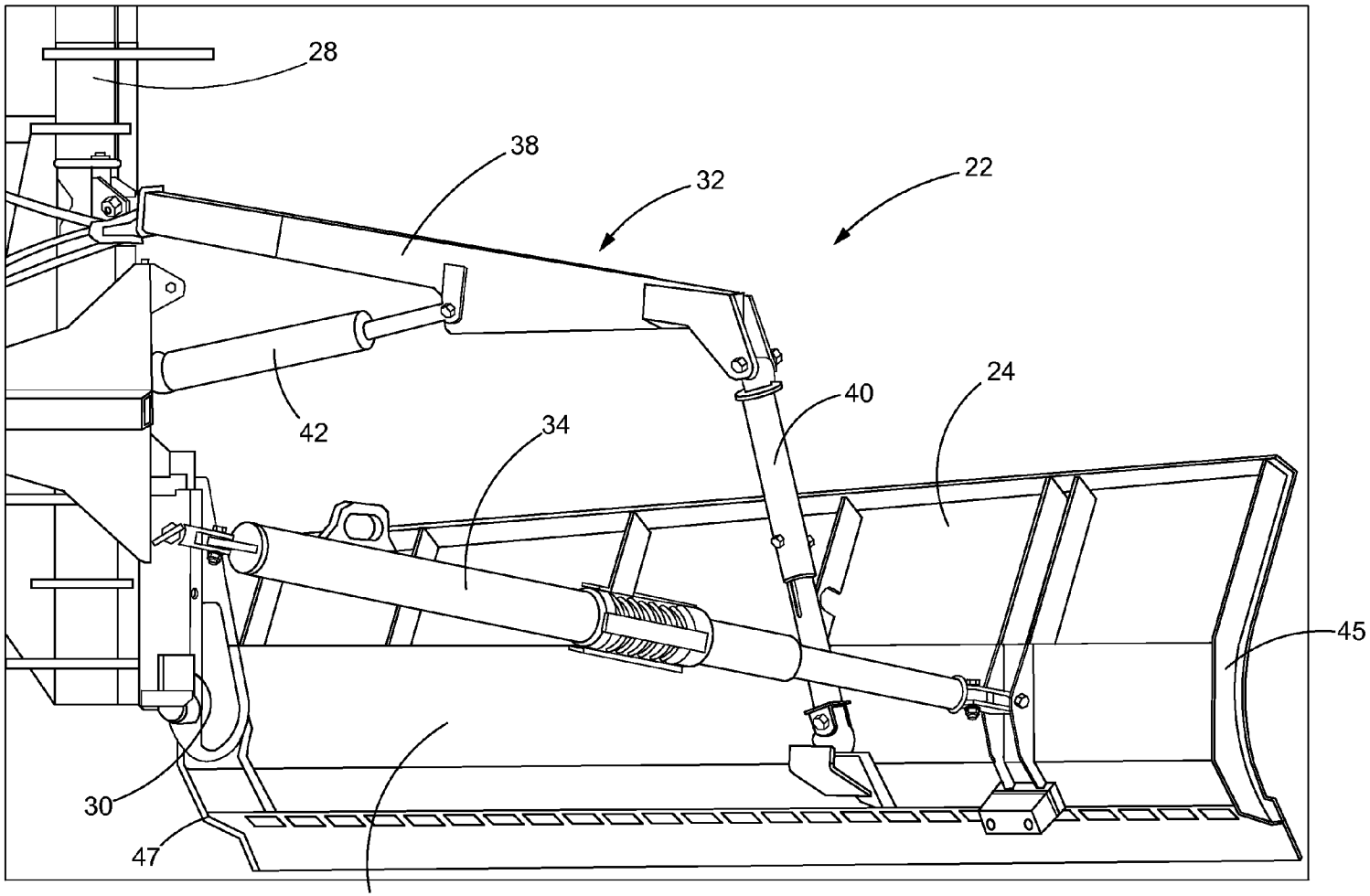
FIG. 2 is a perspective view of a moldboard assembly of the machine of FIG. 1.
Figure 3:
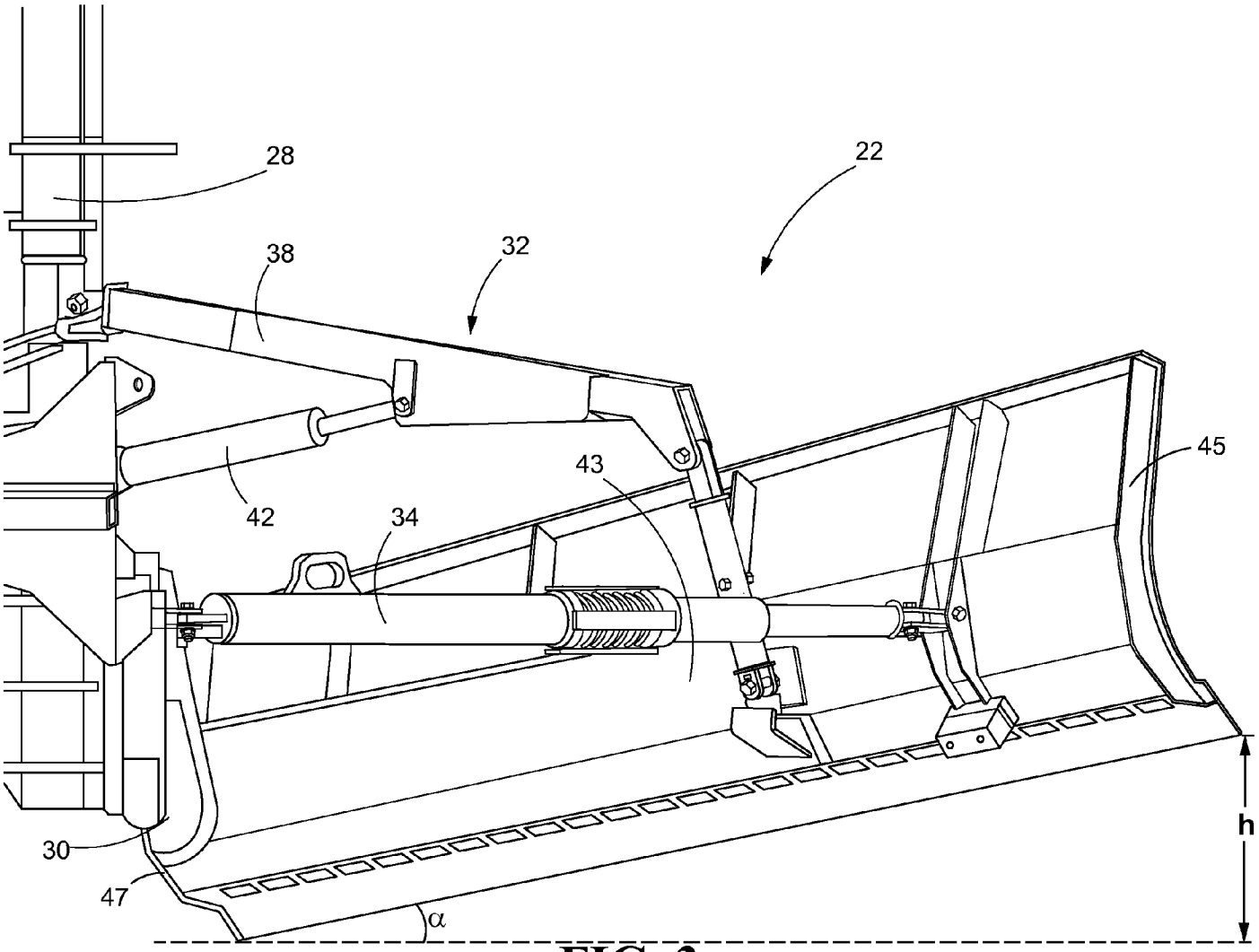
FIG. 3 is a perspective view of the moldboard assembly of FIG. 2 showing a moldboard positioned at a predetermined height and angle.
Figure 4:
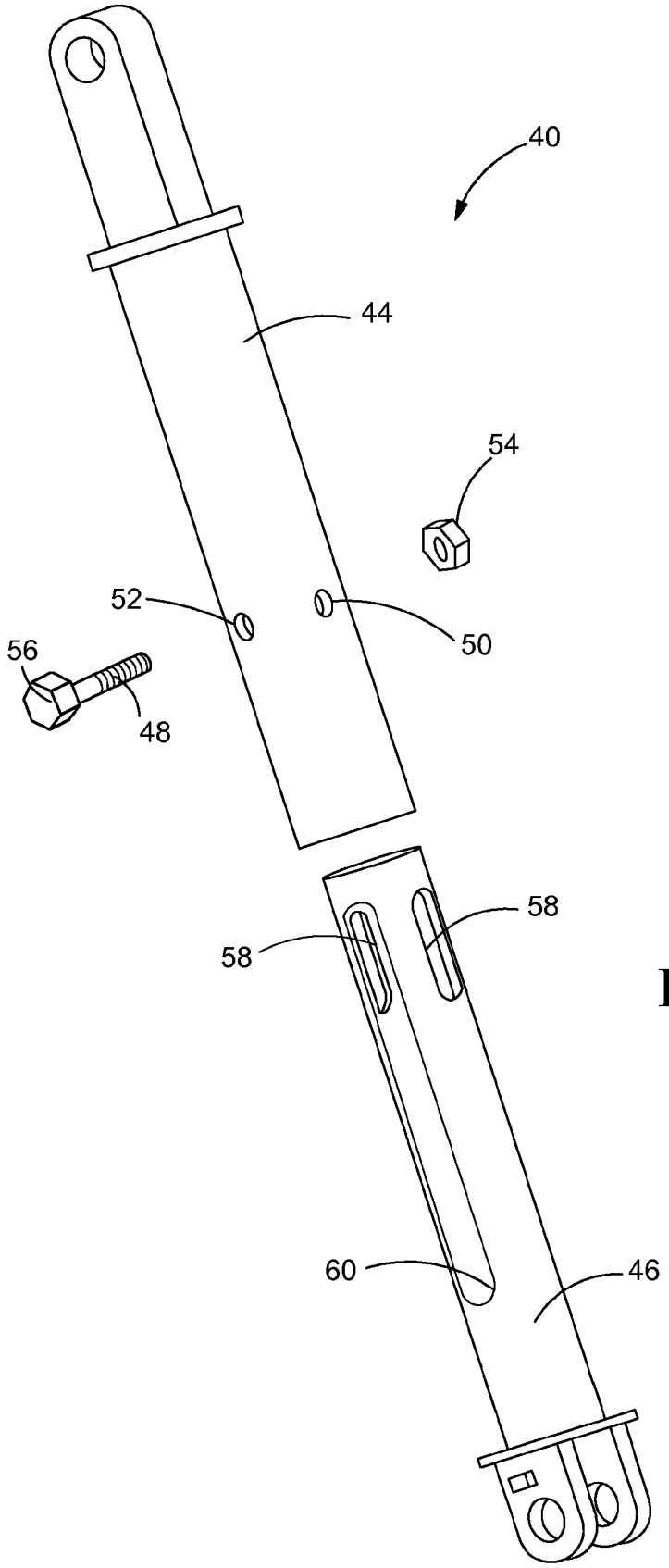
FIG. 4 is an exploded view of a link for a moldboard assembly according to another embodiment.

As shown in FIGS. 1-3, the machine 20 includes a moldboard assembly 22 operatively coupled thereto, such as, without limitation, for removing snow or other materials from the pavement. The moldboard assembly 22 may be permanently attached to the machine 20 or may be temporarily attached, such as, for seasonal use. The moldboard assembly 22 may comprise a blade or moldboard 24 operatively mounted to a side 26 of the machine 20. The moldboard 24 may also be attached to a front or rear of the machine 20 as well.

The moldboard 24 may be mounted to a mast 28 by way of a pivoted connection 30. The moldboard assembly 22 may further comprise a jib arm assembly 32 extending from the mast 28 to the moldboard 24 and a strut 34 extending from a frame 36 of the machine 20 to the moldboard 24. Together the pivoted connection 30, jib arm assembly 32, and strut 34 support and locate the moldboard 24 at a specified distance and angle from the frame 36 of the machine 20. Furthermore, through various mechanisms of the machine 20, such as the mast 28, strut 34, and jib arm assembly 32, the moldboard 24 may be raised, lowered and maintained at different positions. For example, an inner edge 47 of the moldboard 24 and/or an outer edge 45 of the moldboard 24 may be raised well above the ground and tucked in near to the frame 36 of the machine 20 when not in use, and lowered into position for plowing or grading during operation.

The jib arm assembly 32 may include a jib arm 38, a link 40, and a hydraulic cylinder 42. Positioned above the moldboard 24 and extending in a generally horizontal and/or angled orientation from the vertically oriented mast 28, the jib arm 38 may be attached to the mast 28 at a proximal end and may be attached to the link 40 at a distal end. The hydraulic cylinder 42 may extend from the mast 28 to the jib arm 38 and may be used to control the position of the jib arm 38 and moldboard 24. Extending in a generally vertical and/or angled orientation, the link 40 connects the jib arm 38 to the moldboard 24.

The moldboard assembly 22 may be equipped with float capability via the link 40. More specifically, the link 40 may be rigid, as opposed to flexible, and may comprise rigid, telescoping cylinders. It is to be understood that the cylinders may not necessarily be cylindrical in shape, and may be square, rectangular, oval, octagonal or any other shape. Furthermore, the cylinders may be hollow or solid, and may not necessarily be telescoping. For example, the link 40 may comprise u-channel, flat pieces, and the like, which move relative to each other.

When the moldboard 24 strikes an object or encounters other obstacles, the telescoping link 40 quickly retracts in response to the sudden force of the object, thereby allowing the moldboard 24 to float over the object. As shown best in FIG. 2, during operation when no obstacles are present, the moldboard 24 is flat on the ground surface with the link 40 in an extended position. As shown best in FIG. 3, when the moldboard strikes an object, the moldboard rapidly moves upward with the link 40 in a retracted position, in reaction to encountering the object. In so doing, the moldboard 24 can follow any contour of a ground surface without the moldboard getting lodged under obstacles or the machine being forced into the ground or damaged.

It is to be understood that other mounting configurations than that shown and described for the moldboard assembly 22 may certainly be used as well. For example, FIG. 3 shows the link 40 attached between a center 43 and the outer edge 45 of the moldboard 24 such that when the moldboard strikes an object, the link 40 retracts and the moldboard 24 is permitted to move upward to a predetermined maximum height h and angle $\alpha$ relative to the ground surface. However, the link 40 may certainly be attached at a position other than that shown, such as, any position between the inner edge 47 and the outer edge 45 of the moldboard, thereby varying the predetermined maximum height h and angle $\alpha$ of moldboard float.

Referring now to FIGS. 4-11, with continued reference to FIGS. 1-3, the link 40 may comprise an outer cylinder 44, an inner cylinder 46, and a fastener 48. Connected to the outer cylinder 44 by the fastener 48, the inner cylinder 46 may be partially or wholly disposed within the cylinder 44 during machine operation, depending on the ground surface. The outer cylinder 44 may include a plurality of holes, such as, without limitation, a first pair of diametrically opposed holes 50 and a second pair of diametrically opposed holes 52. It is certainly possible for the first and second pairs of holes 50, 52 to not be diametrically opposed. The plurality of holes 50, 52 may be equally spaced around a circumference of the outer cylinder 44. Although the outer cylinder 44, in FIGS. 4-11, includes four holes spaced ninety degrees (90°) apart from each other, other numbers of holes and arrangements are certainly possible.

Each of the holes 50, 52 in the outer cylinder 44 may be sized to receive the fastener 48 in a locking arrangement. For example, the fastener 48 may comprise a nut 54 and a bolt 56, and the holes 50, 52 may securely receive the bolt 56, with the nut 54 locking the bolt 56 in place on the outer cylinder 44. The holes 50, 52 may also be threaded to receive the bolt 56. Other locking configurations for the fastener 48 and outer cylinder 44, such as but not limited to pins, hitch pins, lynch pins, and the like, are certainly possible. In addition, retention elements other than the nut 54 and bolt 56 may certainly be used for the fastener 48.

Figure 5:
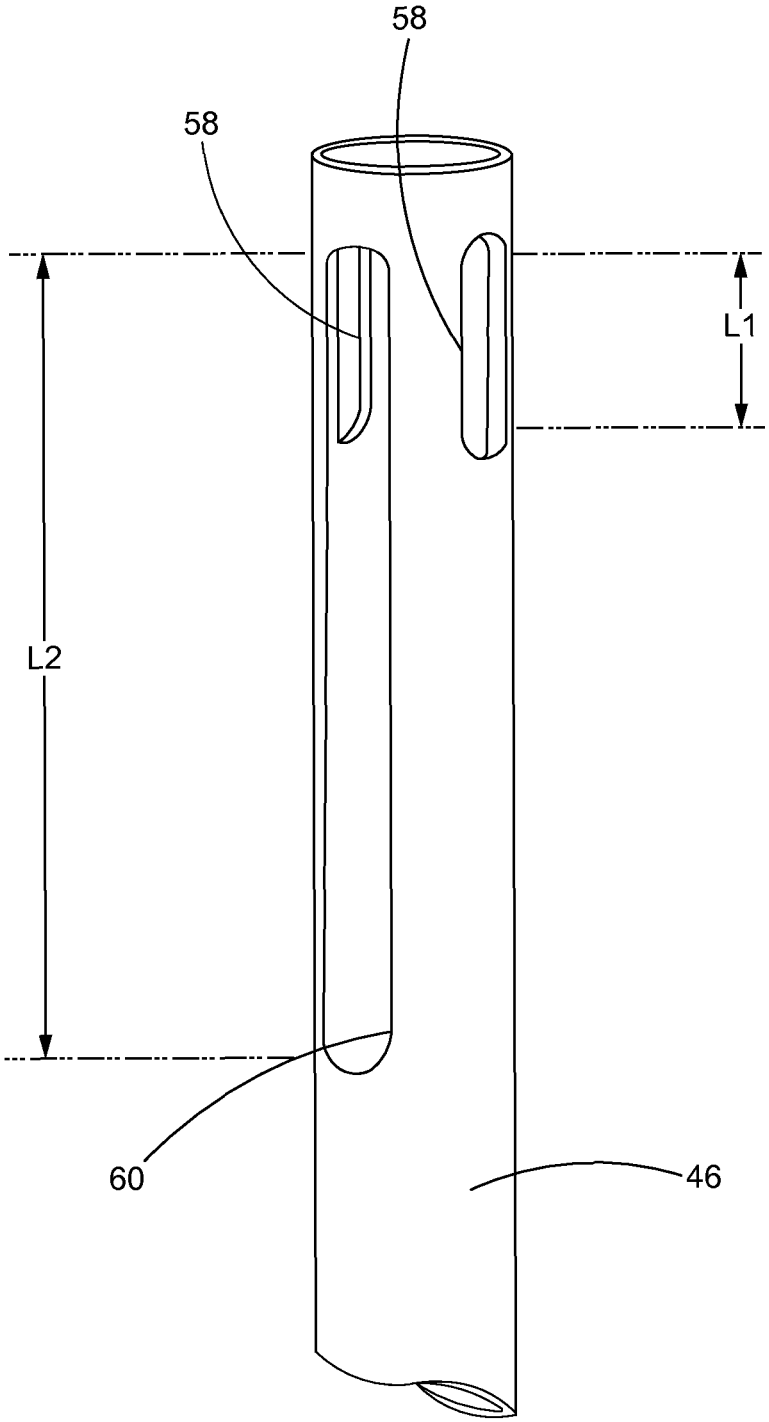
FIG. 5 is a partial view of an inner tube of the link of FIG. 4.

As shown best in FIG. 5, the inner cylinder 46 may include a plurality of slots, such as, without limitation, a first pair of diametrically opposed slots 58 and a second pair of diametrically opposed slots 60. It is certainly possible for the first and second pairs of slots 58, 60 to not be diametrically opposed. When assembled, as shown in FIGS. 6-9, the first pair of slots 58 in the inner cylinder 46 may be configured to align with the first pair of holes 50 in the outer cylinder 44, and the second pair of slots 60 configured to align with the second pair of holes 52 in the outer cylinder 44. Furthermore, each of the slots 58, 60 may be sized to permit the bolt 56 to move across a length of the slot from one end to another. Additional slots of different lengths may be provided if an even greater range of float adjustability is desired.

Figure 10:
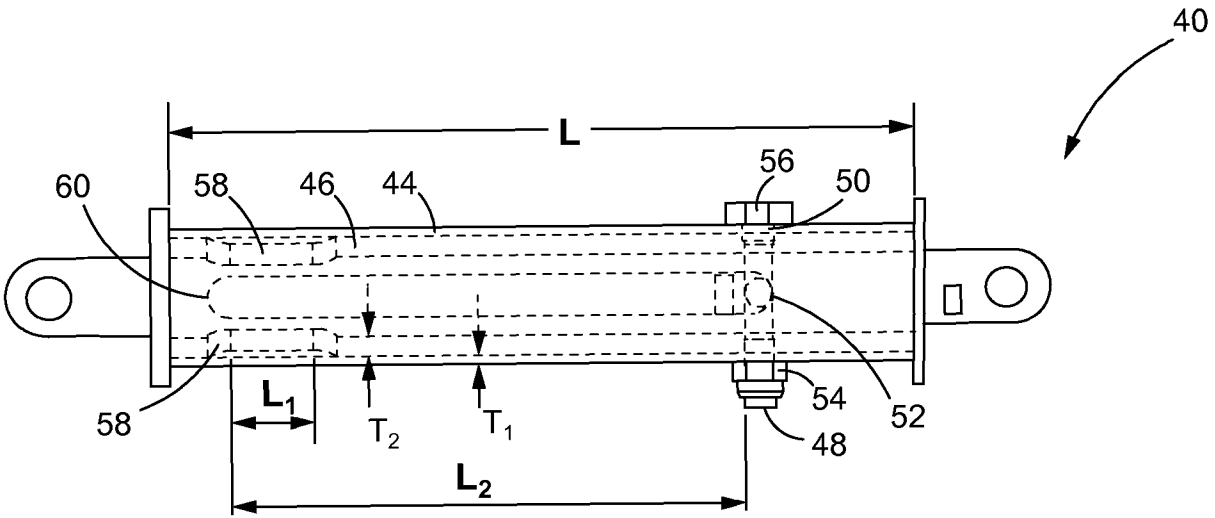
FIG. 10 is a diagrammatic view of the link of FIG. 4 in the first fully retracted position.

As shown best in FIG. 10, the outer cylinder 44 and inner cylinder 46 may be approximately equal in length L. However, the outer cylinder 44 and inner cylinder 46 may be unequal in length as well. In one example, the length L of both the outer and inner cylinders 44, 46 may be about 475 mm, although other lengths are certainly possible. In addition, a thickness $T_2$ of the inner cylinder 46 may be greater than a thickness $T_1$ of the outer cylinder 44 in order to reinforce a strength of the inner cylinder 46 while accommodating the slots 58, 60. However, this may not always be the case.

Moreover, the first pair of slots 58 may have a length $L_1$ that is not equal to a length $L_2$ of the second pair of slots 60 in order to provide varying ranges of float capability. The length $L_1$ of the first pair of slots 58 may provide a first range of float capability, while the length $L_2$ of the second pair of slots 60 may provide a second range of float capability. For example, the length $L_2$ of the second pair of slots 60 may be greater than the length $L_1$ of the first pair of slots 58. In so doing, the first pair of slots 58 may be used when a shorter range of float capability is desired, and the second pair of slots 60 may be used when a greater range of float capability is desired.

Figure 6:
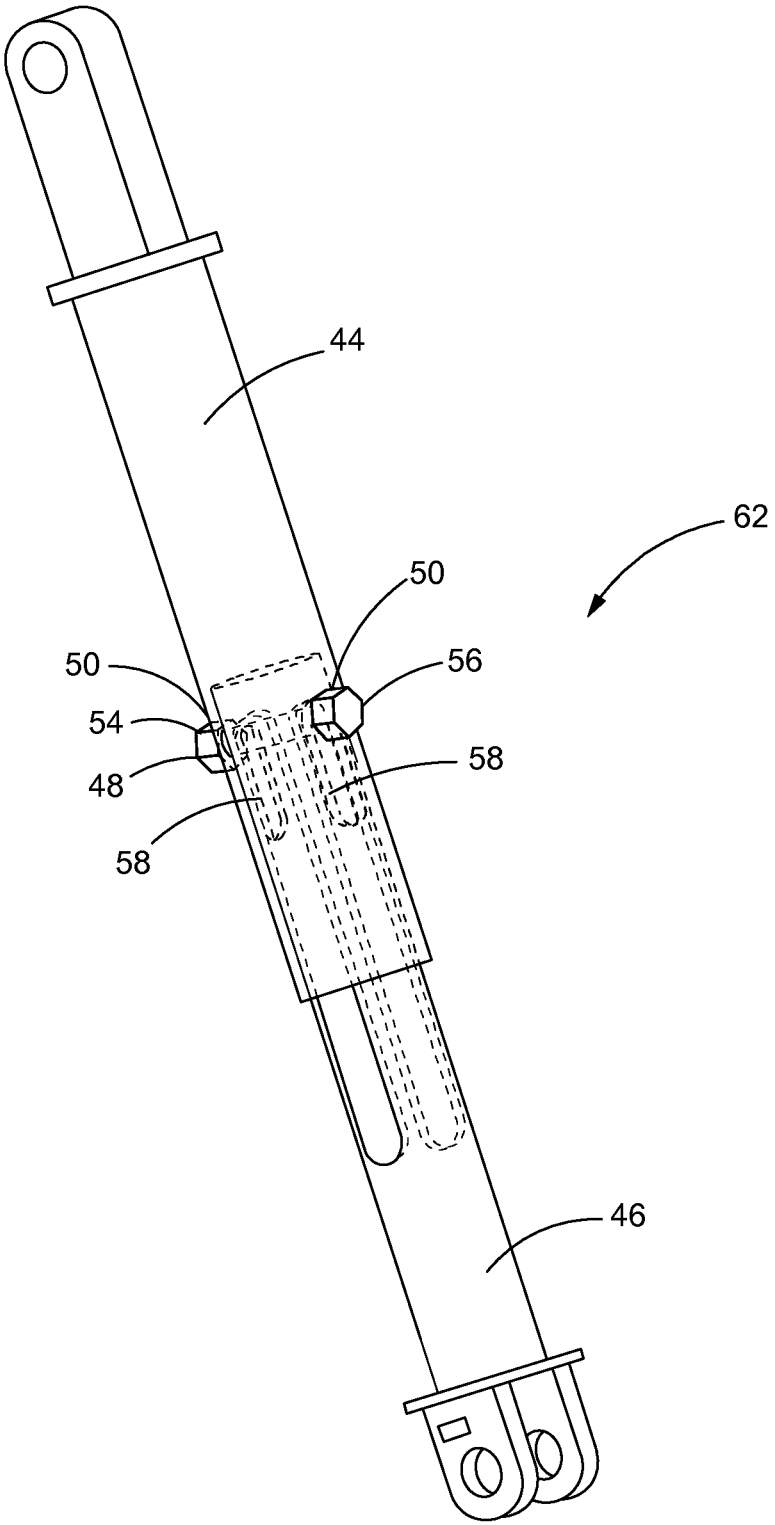
FIG. 6 is a perspective view of the link of FIG. 4 in a first fully extended position.
Figure 7:
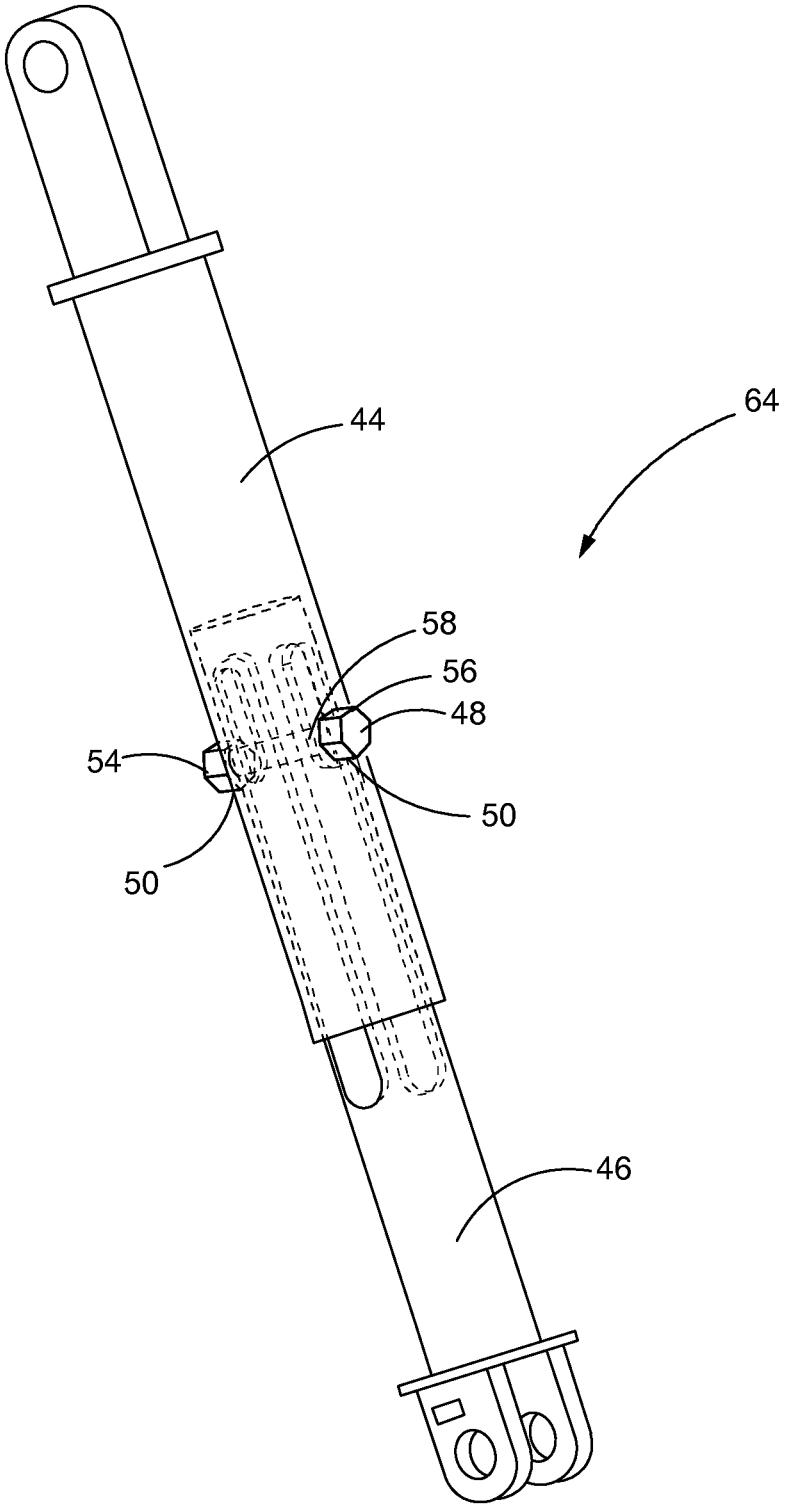
FIG. 7 is a perspective view of the link of FIG. 4 in a first fully retracted position.
Figure 8:
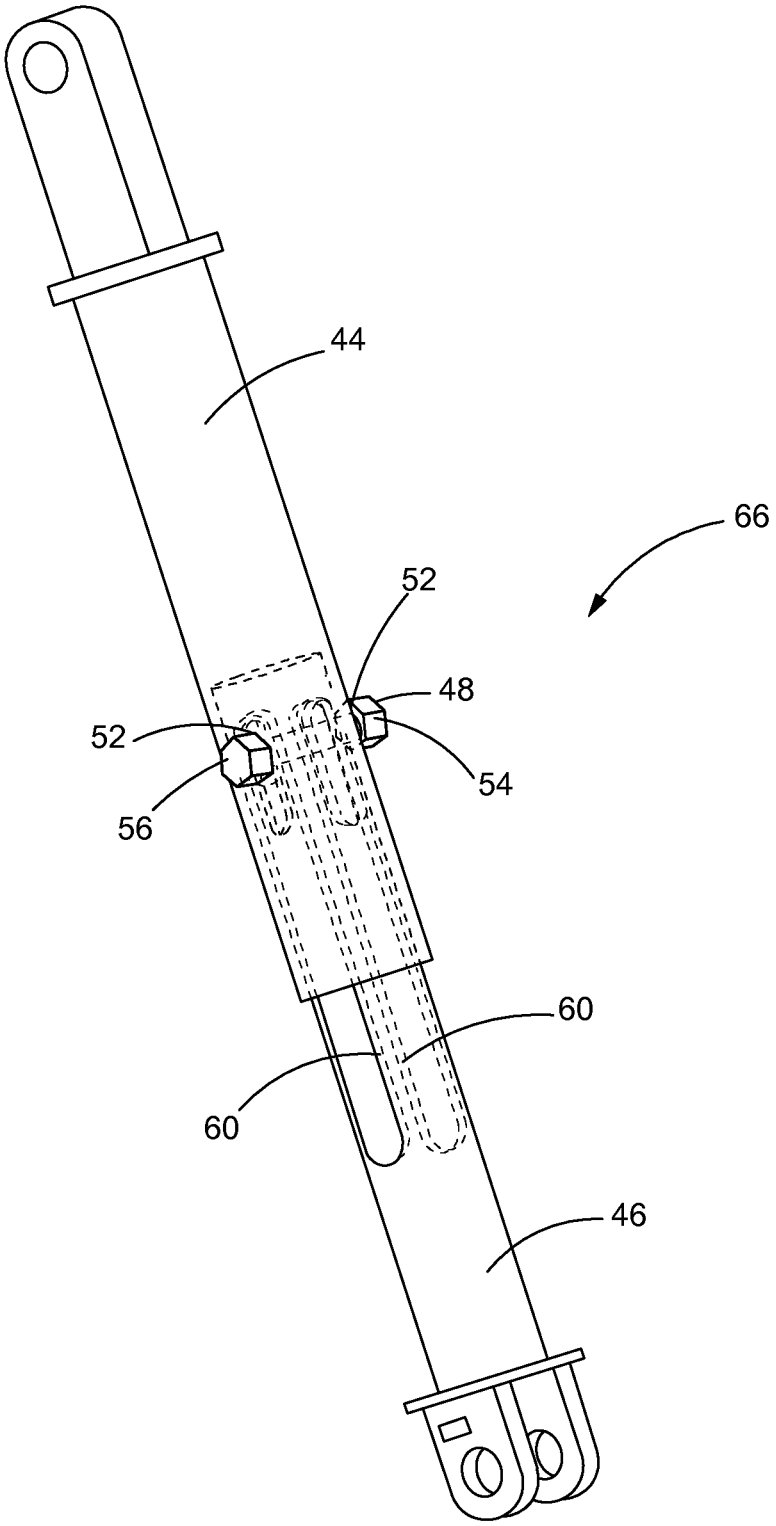
FIG. 8 is a perspective view of the link of FIG. 4 in a second fully extended position.
Figure 9:
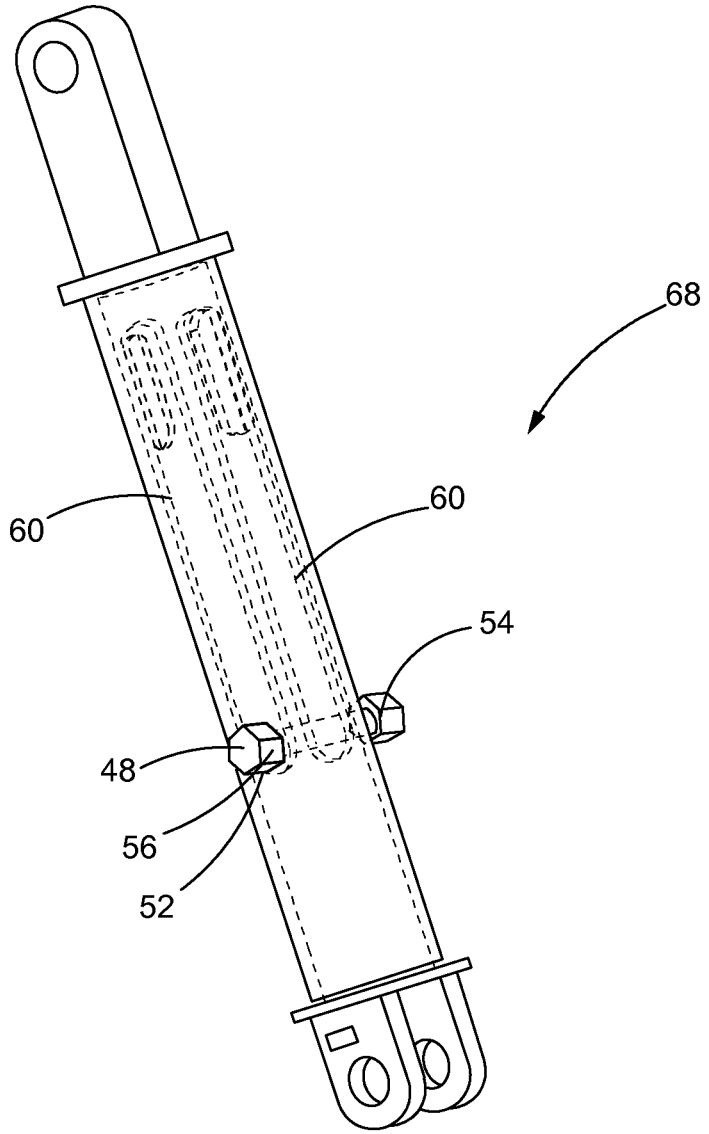
FIG. 9 is a perspective view of the link of FIG. 4 in a second fully retracted position.

More specifically, when the first range of float capability is desired, the fastener 48 may be secured through the first pair of holes 50 in the outer cylinder 44 and the first pair of slots 58 in the inner cylinder 46. When the ground surface is flat during machine operation, the link 40 may remain in a first fully extended position 62 (FIG. 6). When the moldboard 24 strikes an object or an obstacle is encountered, the inner cylinder 46 of the link 40 reactively moves upward relative to the fastener 48 and the outer cylinder 44, thereby causing the moldboard 24 to also move upward. The inner cylinder 46 may move vertically upward, such as, to a first fully refracted position 64 (FIG. 7), depending on a force of impact. A maximum vertical movement of the inner cylinder 46 and the predetermined maximum height h (FIG. 3) of the moldboard 24 is constrained by the length $L_1$ of the first pair of slots 58.

When the second range of float capability is desired, the fastener 48 may be secured through the second pair of holes 52 in the outer cylinder 44 and the second pair of slots 60 in the inner cylinder 46. When the ground surface is flat during machine operation, the link 40 may remain in a second fully extended position 66 (FIG. 8), which may be equivalent to the first fully extended position 62 (FIG. 6). However, when the moldboard 24 strikes an object or encounters an obstacle, the inner cylinder 46 of the link 40 may travel a greater distance upward, such as, to a second fully refracted position 68 (FIG. 9), depending on a force of impact. The maximum vertical movement of the inner cylinder 46 and the predetermined maximum height h (FIG. 3) of the moldboard 24 is constrained by the length $L_2$ of the second pair of slots 60. Since the length $L_2$ of the second pair of slots 60 is greater than the length $L_1$ of the first pair of slots 58, the maximum vertical movement of the inner cylinder 46 and the predetermined maximum height h of the moldboard is greater for the second range of float capability than it is for the first range of float capability.

To switch from the first range of float capability to the second range of float capability, the fastener 48 may be simply removed from the first pair of holes 50 and the first pair of slots 58, then inserted and secured through the second pair of holes 52 and the second pair of slots 60. To switch from the second range of float capability to the first range of float capability, the fastener may be simply removed from the second pair of holes 52 and the second pair of slots 50, then inserted and secured through the first pair of holes 50 and the first pair of slots 58. In so doing, the link 40 provides multiple, adjustable float capabilities to the moldboard 24 of the machine 20 in a user-friendly and time-efficient manner.

A moldboard float ratio, or a ratio of the length $L_2$ of the second pair of slots 60 to the length $L_1$ of the first pair of slots 58 ($L_2$:$L_1$), may be between an inclusive range of five-to-one (5:1) and eight-to-one (8:1). It is certainly possible for the moldboard float ratio to be greater than eight-to-one (8:1) or less than five-to-one (5:1), as well. For instance, the moldboard float ratio may be six-to-one (6:1). In one example, the length $L_1$ of the first pair of slots 58 may be between an inclusive range of approximately 25-102 mm, such as, without limitation, about 54 mm. The length $L_2$ of the second pair of slots 60 may be between an inclusive range of approximately 127-457 mm, such as, without limitation, about 200 mm or about 400 mm. It is certainly possible to have other lengths L, $L_1$, $L_2$ than that described above for the cylinders 44, 46 and slots 58, 60.

Figure 11:
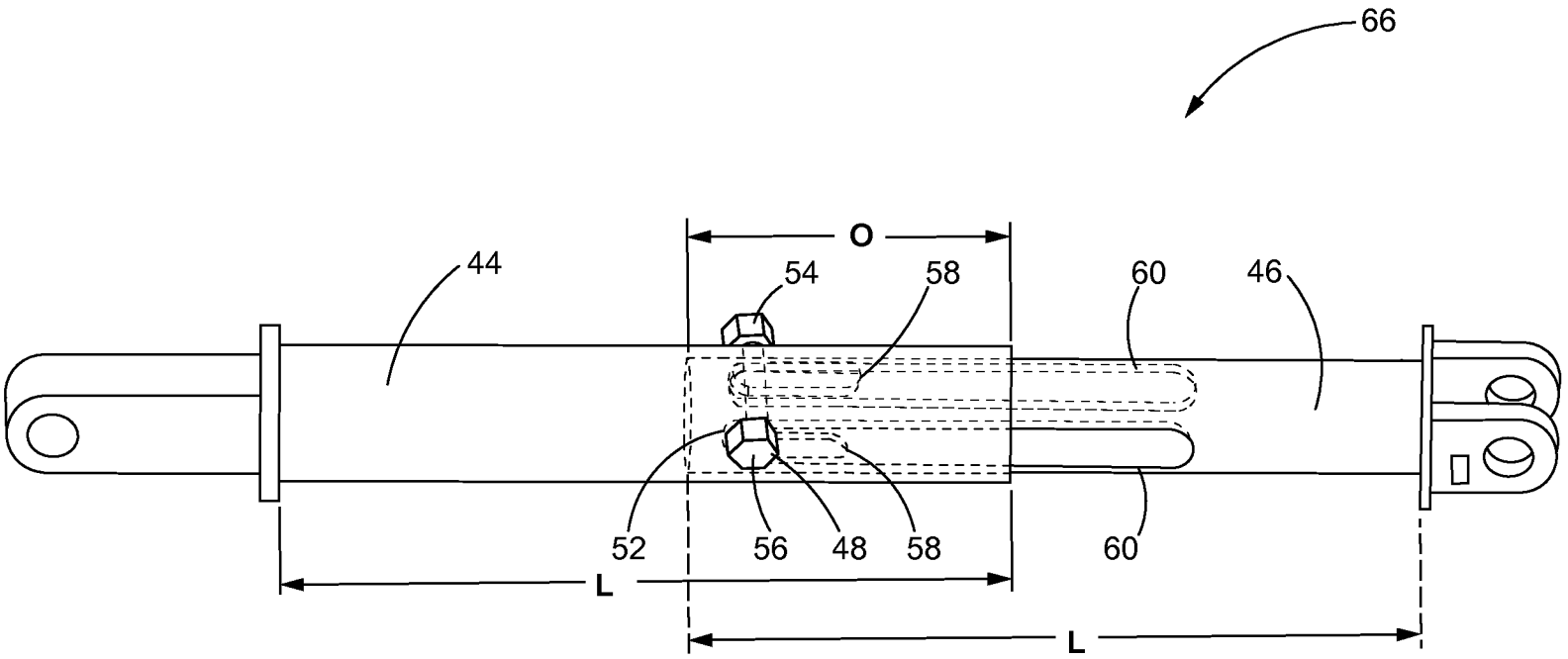
FIG. 11 is a diagrammatic view of the link of FIG. 4 in the second fully extended position.

As shown best in FIG. 11, when the link 40 is at a maximum extension, e.g., in the second fully extended position 66 (or the first fully extended position 62 in FIG. 6), there may be an overlap O of the outer cylinder 44 and the inner cylinder 46. The overlap O may provide link group stability at the fully-extended position. In an embodiment, the overlap O of the outer cylinder 44 and the inner cylinder 46 may be no less than twenty-five percent of the length L of the outer or inner cylinder 44, 46. For example, the overlap O may be no less than twenty-five percent of an average of the lengths of the outer and inner cylinders. The ratio of cylinder length L to the cylinder overlap O may be four-to-one (4:1). In other embodiments, the overlap O may certainly be more than twenty-five percent of the length L, and the ratio of cylinder length L to overlap O may be greater or less than four-to-one (4:1).

Figure 12:
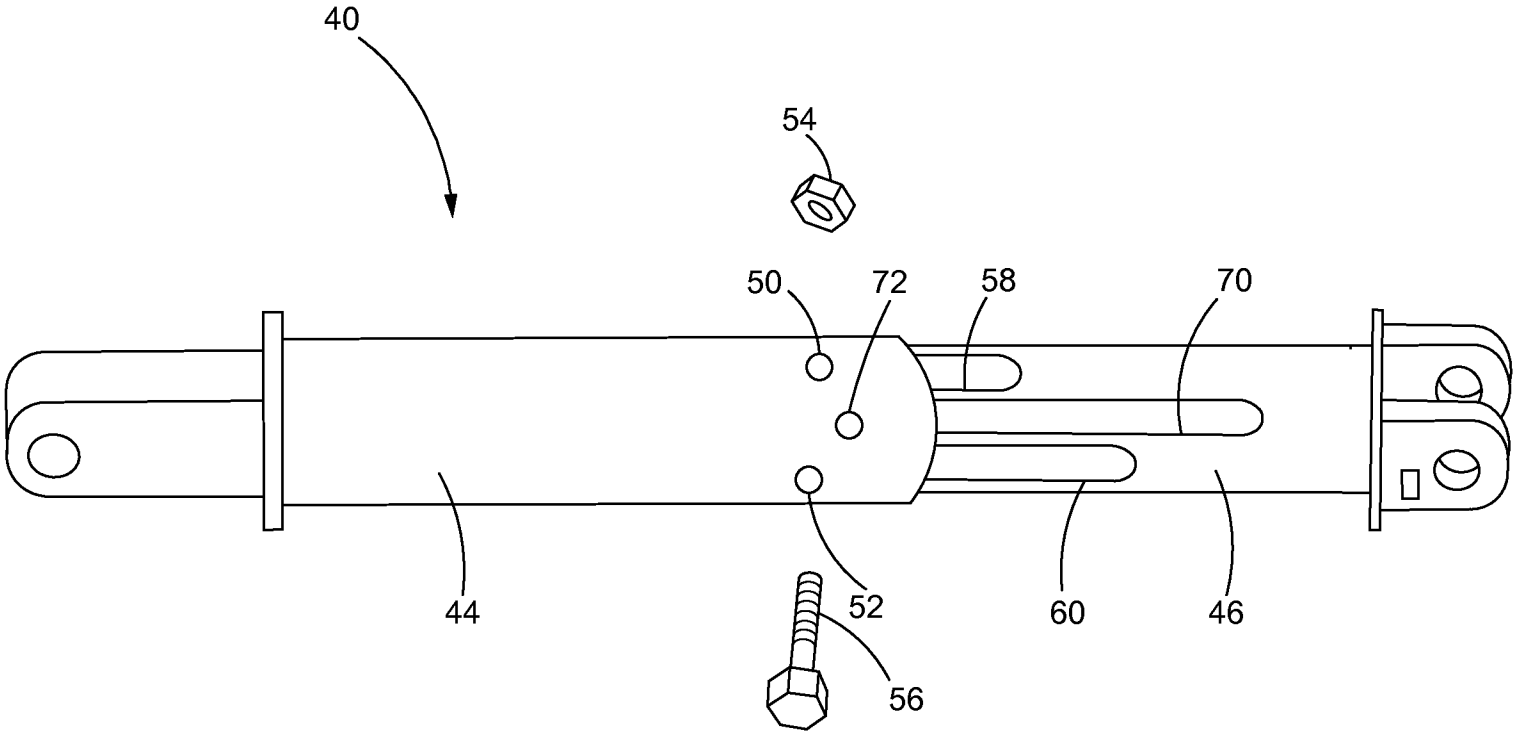
FIG. 12 is a perspective view of a link according to another embodiment.
Figure 13:
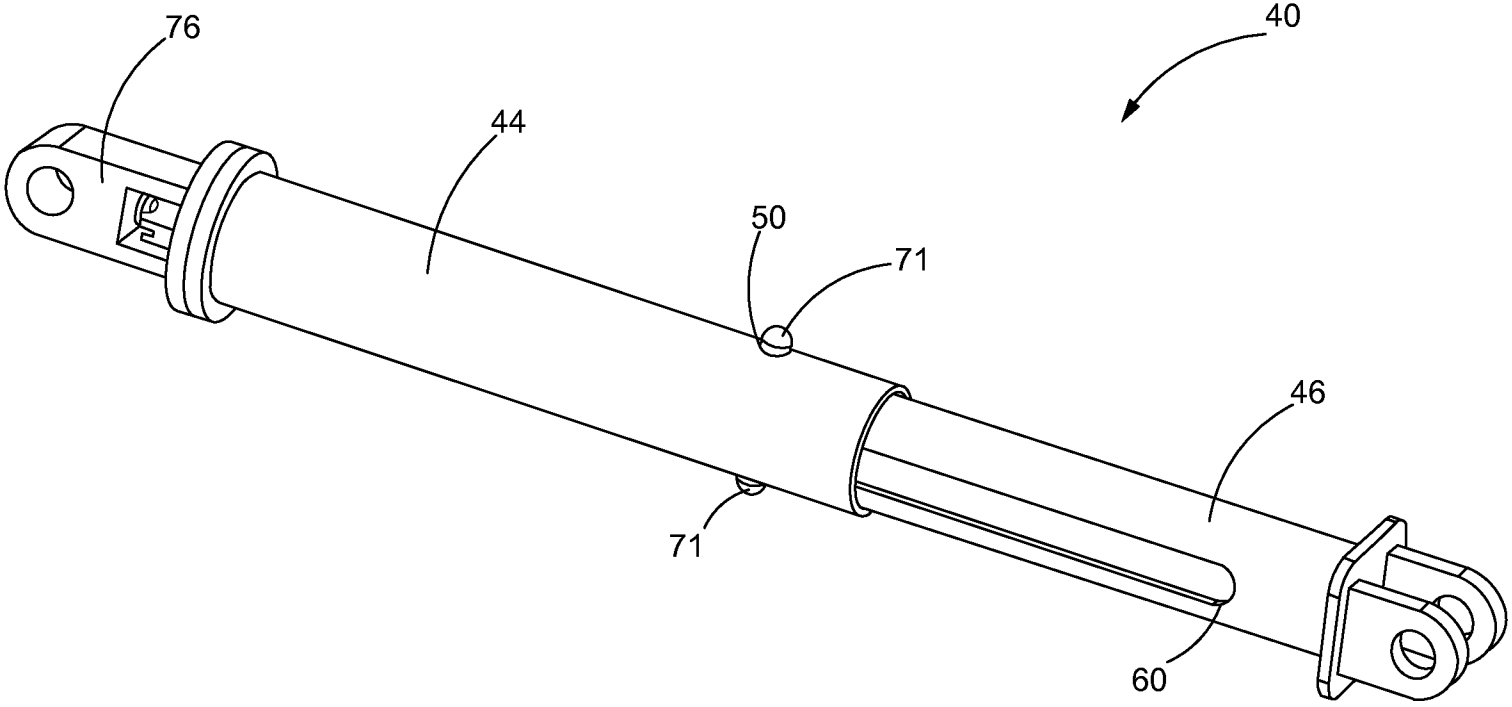
FIG. 13 is a perspective view of a link according to another embodiment.
Figure 14:
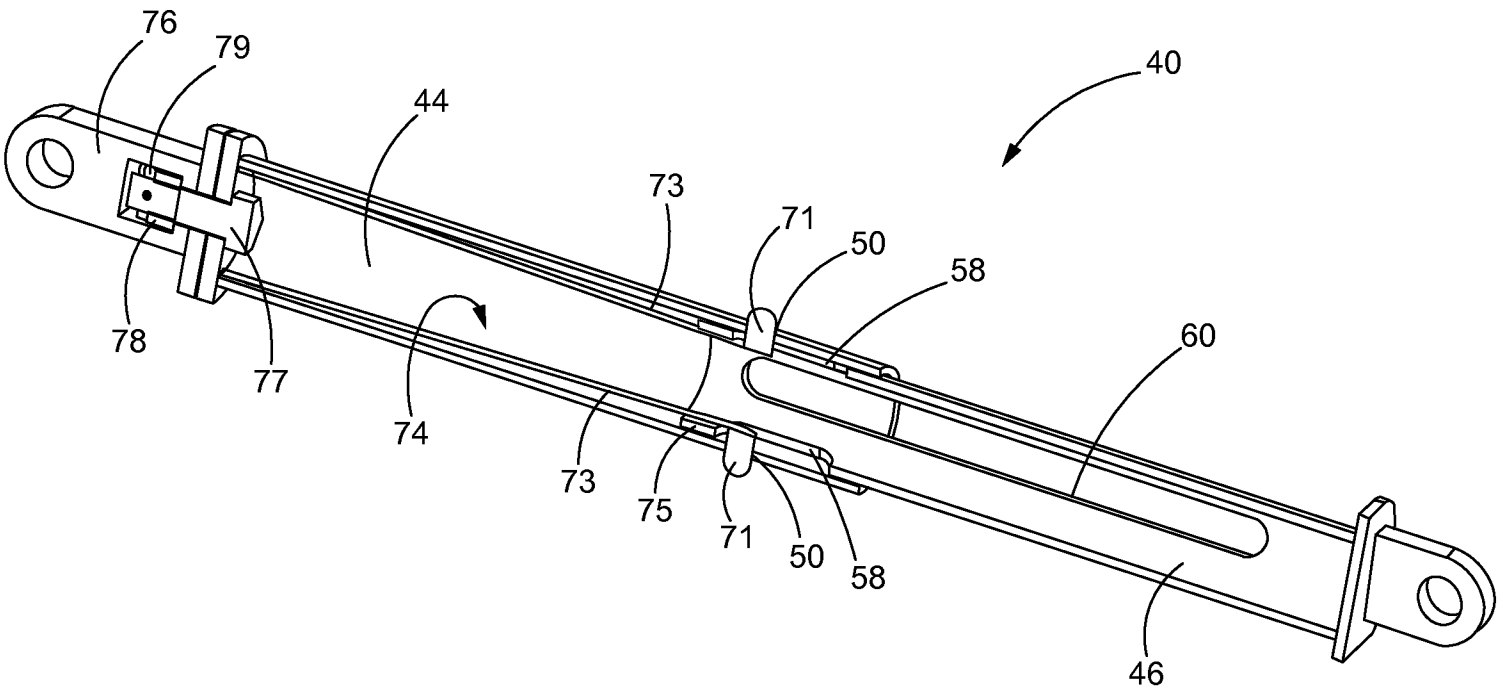
FIG. 14 is a perspective view of an inside of the link of FIG. 13.
Figure 15:
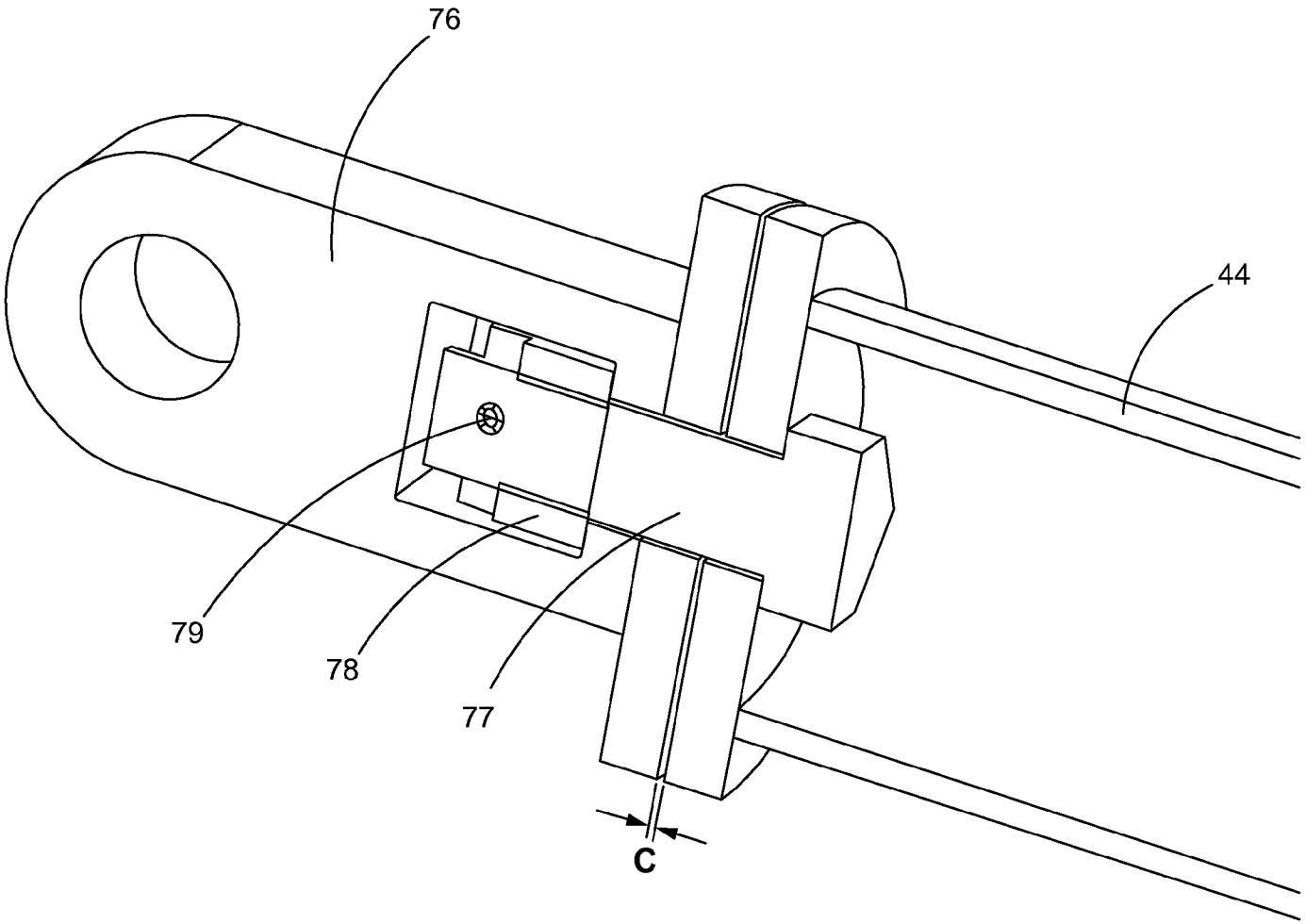
FIG. 15 is a partial view of a swivel arrangement of the link of FIG. 13.

It is to be understood that the link 40 may have more than two pairs of slots 58, 60. In an example shown best in FIG. 12, the inner cylinder 46 of the link 40 may further include a third (or more) pair of diametrically opposed slots 70 aligned with a third (or more) pair of diametrically opposed holes 72 in the outer cylinder 44. The first, second, and third pair of holes 50, 52, 72 may be equally spaced apart from each other around a circumference of the outer cylinder 44. Furthermore, the third pair of slots 70 may have a length greater than the length of the second pair of slots 60. In so doing, three (or more) ranges of float capability may be provided to the moldboard assembly 22 of the machine 20. For instance, the first pair of slots 58 may have a length of about 54 mm, the second pair of slots 60 may have a length of about 152 mm, and the third pair of slots 70 may have a length of about 356 mm, although other lengths are certainly possible.

According to another embodiment, shown best in FIGS. 13-17, the link 40 may include spring-loaded button pins 71 (instead of a fastener) configured to connect the outer cylinder 44 to the inner cylinder 46. Configured to engage with the holes 50 in the outer cylinder 44, the spring-loaded pins 71 may be disposed through either the first pair of slots 58 or the second pair of slots 60 in the inner cylinder 46. The pins 71 may include flat springs 73 attached to an inner surface 74 of the outer cylinder 44. For example, the flat springs 73 may be tack welded to the outer cylinder 44, although other means of attachment are certainly possible.

It is to be understood that the flat springs 73 may be attached at any length along the inner surface 74 of the outer cylinder 44. Furthermore, to accommodate telescoping movement of the cylinders 44, 46, the outer cylinder 44 may have a longer length than the inner cylinder 46 such that the inner cylinder 46 does not interfere with the attachment of the flat springs 73 to the inner surface 74 of the outer cylinder 44 when the inner cylinder 46 is fully retracted within the outer cylinder 44. Other configurations are certainly possible. For example, an end 75 of the inner cylinder 46 may include openings (not shown) sized to permit the flat springs 73 to slide through the inner cylinder 46 but not the pins 71.

In addition, other arrangements than that shown and described for the spring-loaded pins 71 are certainly possible. For example, the spring-loaded pins 71 may be attached to an outer surface of the outer cylinder 44 such that they engage/disengage with the inner cylinder 46 from the outer surface of the outer cylinder 44. Furthermore, other springs or configurations than flat springs 73 may certainly be used to impart load on the pins 71.

The link 40 may include a swivel arrangement between the outer cylinder 44 and a flange 76 configured to affix the link 40 to the moldboard 24. For example, a bolt 77, a castle nut 78, and a cotter pin 79 may be used to retain the flange 76 to the outer cylinder 44, although other configurations for the swivel arrangement are certainly possible. There may also be a minimal clearance distance C between the flange 76 and the outer cylinder 44. In so doing, the outer cylinder 44 may freely rotate with respect to the flange 76. It is to be understood that alternatively or in addition to the swivel arrangement for the outer cylinder 44 and the flange 76, the inner cylinder 46 may have a swivel arrangement in order to permit free rotation of the inner cylinder 46. Furthermore, the swivel arrangement may be used in other configurations as well, such as the embodiment shown in FIGS. 1-12.

Figure 16:
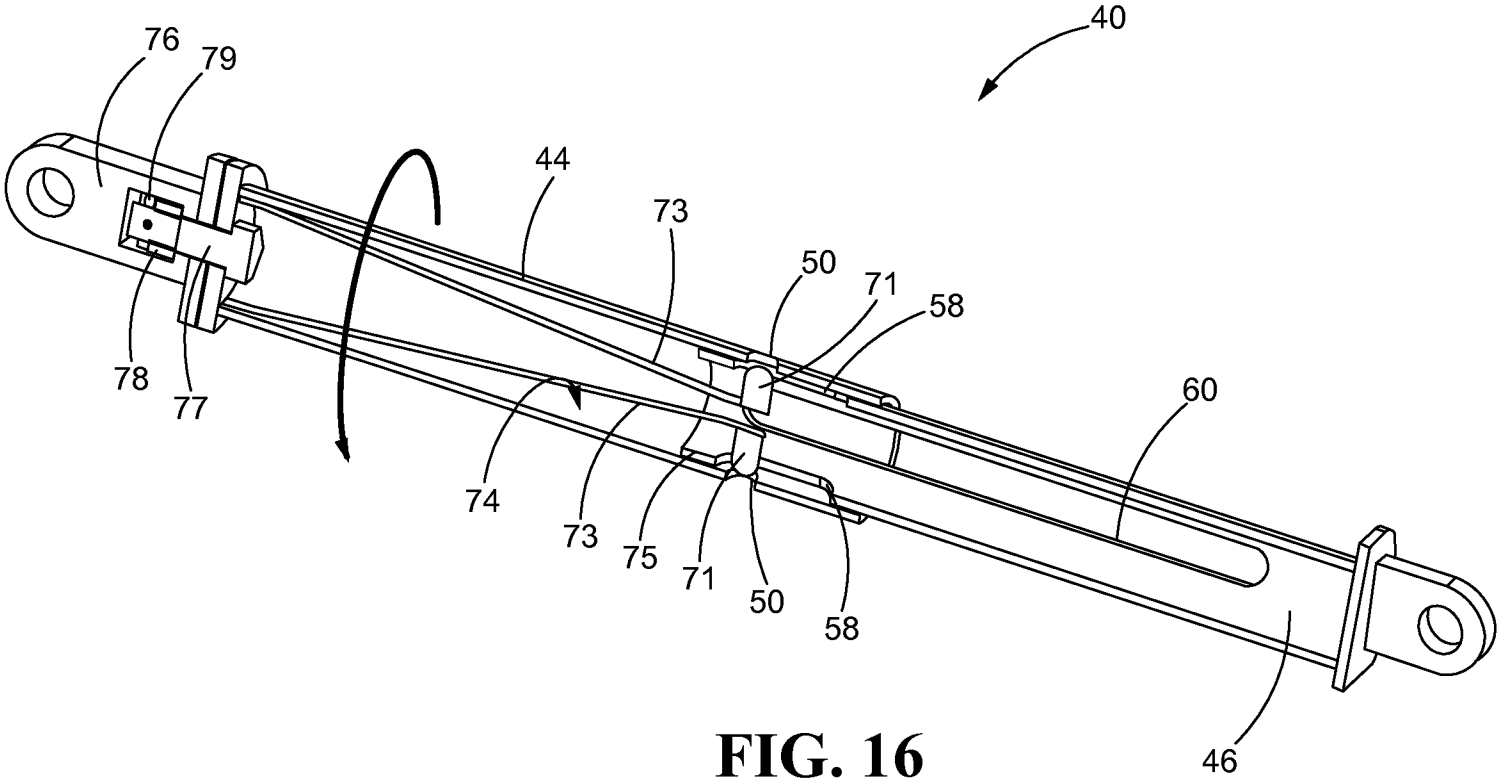
FIG. 16 is a perspective view of the inside of the link of FIG. 13 with depressed spring-loaded pins.
Figure 17:
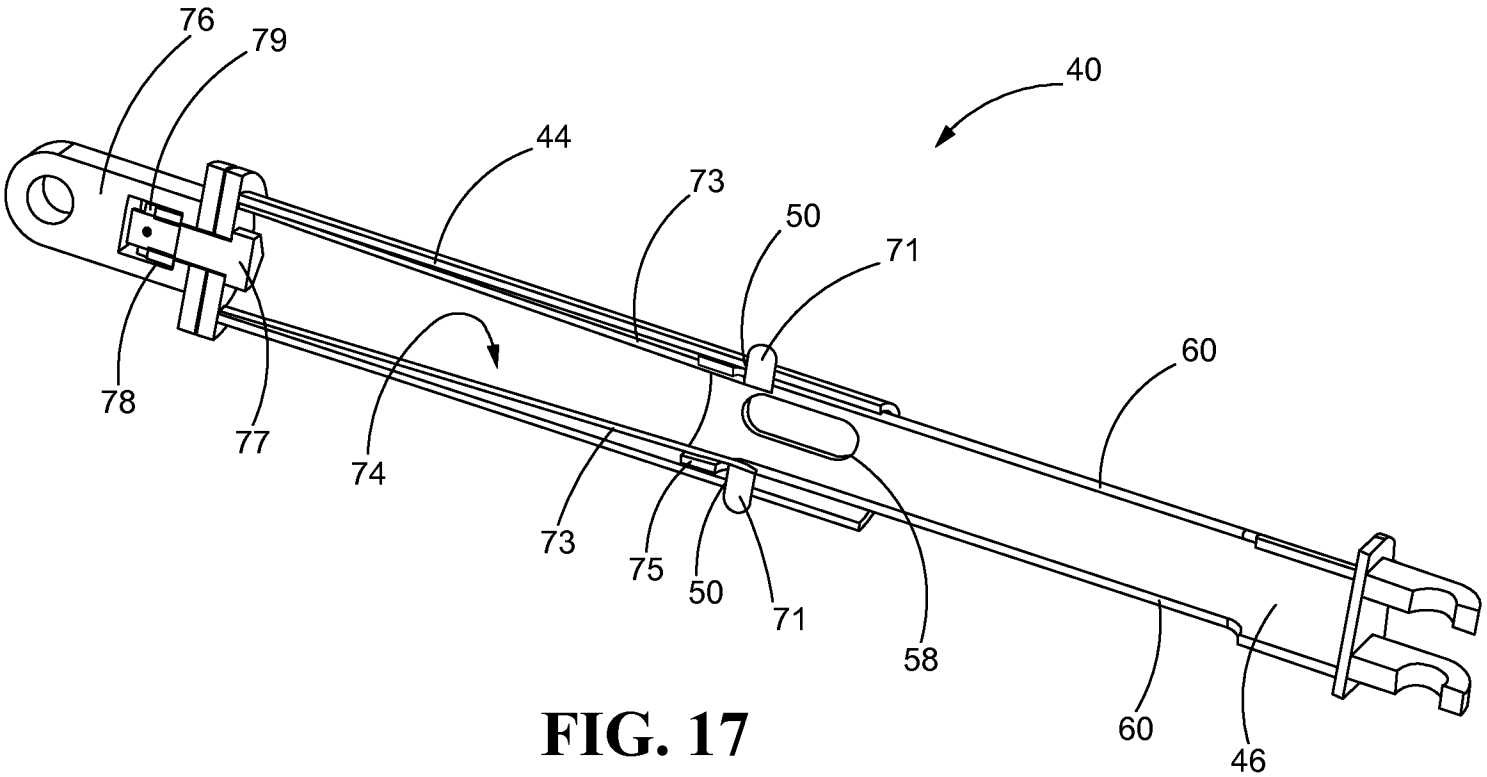
FIG. 17 is a perspective view of the inside of the link of FIG. 13 with released spring-loaded pins in a second pair of slots.

As shown best in FIG. 16, in order to switch from the first range of float capability to the second range of float capability (or vice versa), the pins 71 may be depressed, and the outer cylinder 44 may be rotated. For example, the pins 71 may be depressed to disengage from the holes 50 in the outer cylinder 44 and the first pair of slots 58 in the inner cylinder 46. A tool (not shown) may be used to depress the pins 71, although it is certainly possible to not use a tool as well. The outer cylinder 44 may then be rotated such that the pins 71 and holes 50 are aligned with the second pair of slots 60 in the inner cylinder 46.

For example, the outer cylinder 44 may be rotated ninety degrees (90°) from the first pair of slots 58 to the second pair of slots 60 (or vice versa). It is to be understood that the inner cylinder 46 may be rotated instead of, or in addition to, the outer cylinder 44 when switching from one range of float capability to the other range of float capability. Furthermore, the angle of rotation of the outer cylinder 44 and/or inner cylinder 46 to change from one range of float capability to the other may not necessarily be ninety degrees (90°). Other angles are certainly possible depending on the location of the slots and holes. Once aligned with the second pair of slots 60, the pins 71 may be released to re-engage with the holes 50 in the outer cylinder 44, as shown best in FIG. 17. Although shown and described as having pairs of pins 71, holes 50, and slots 58, 60, it is possible for the link 40 to only have only one pin 71, one hole 50, one first slot 58, and one second slot 60, or any number of each.

Figure 18:
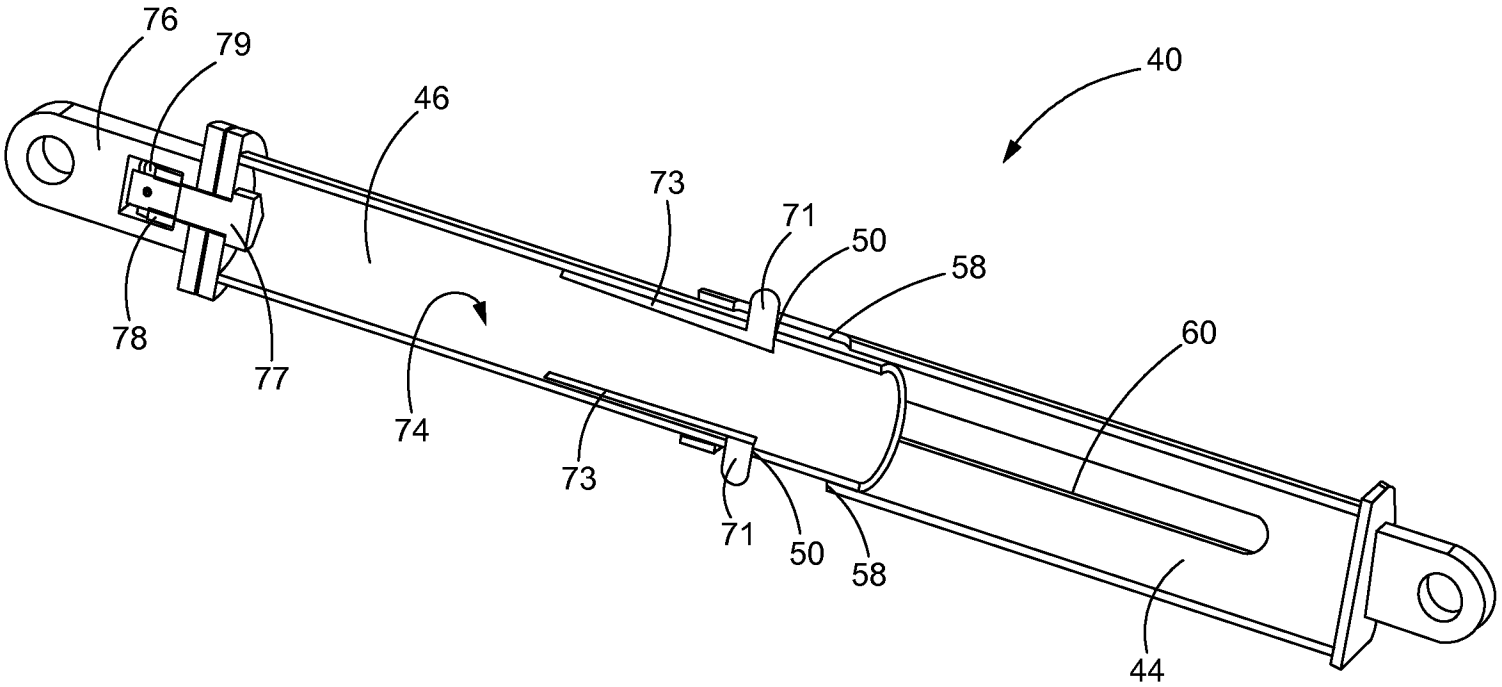
FIG. 18 is a perspective view of an inside of a link according to another embodiment.

It is to be understood that the hard link 40 may be used on any machine that needs multiple, adjustable float capabilities, as well as in any application needing more than one range of motion. In addition, the link 40 may be assembled or manufactured differently. In one embodiment, the inner cylinder 46 may be attached to the jib arm 38 and the outer cylinder 44 may be attached to the moldboard 24. For example, as shown best in FIG. 18, the outer cylinder 44 (which may be connected to the moldboard 24 in FIG. 1) may have slots 58, 60, while the spring-loaded pins 71 may be attached to the inner cylinder 46 (which may be connected to the jib arm 38 in FIG. 1). It is to be understood that the terms "outer" in outer cylinder 44 and "inner" in inner cylinder 46 are not intended to limit the configuration of the link 40, and that either cylinder 44, 46 can fit within the other.

Furthermore, other structures than telescoping hollow cylinders 44, 46 may be used. For instance, the cylinders may not necessarily be cylindrical in shape, and may be square, rectangular, oval, octagonal or any other shape. The cylinders may be hollow or solid, and may not necessarily be telescoping. For example, the link 40 may comprise u-channel, flat pieces, and the like, which move relative to each other. In addition, other means than holes and slots may certainly be used to connect the cylinders and provide more than one float capability in the link 40.

INDUSTRIAL APPLICABILITY

In general, the foregoing disclosure finds utility in various industrial applications, such as in grading, landscaping, mining, plowing, construction, earthmoving, industrial, agricultural, and transportation machines. In particular, the disclosed link may be applied to any machine (e.g., truck, motor grader, wheel loader, bulldozer, or other machine) needing float capability (e.g., for a moldboard assembly or other implement).

By applying the disclosed link to a moldboard assembly for a machine, more than one range of float capability is provided to the moldboard. For example, if the moldboard is being applied to grade flat ground surfaces, a limited float capability may be desired. For this application, the first pair of slots in the link having a shorter length/float capability would be utilized to achieve a limited range of upward motion. However, if the moldboard is being applied to an uneven ground surface having ditches and/or mounds, an extended float capability may be desired. For this application, the second pair of slots in the link having a greater length/float capability would be utilized to achieve an extended range of upward motion.

Furthermore, it is important to note the ease and convenience with which an operator of the machine can switch the link between the two (or more) ranges of float capability. The single-piece hard link disclosed herein is all that is necessary to provide multiple, adjustable float capabilities to the moldboard of the machine. No added parts, storage area, or tools are needed to provide the second range of float capability because both ranges are integrated into one mechanism. In order to switch from the limited float capability (e.g., shorter range of upward motion) to the extended float capability (e.g., longer range of upward motion), or vice versa, the operator simply has to change the location of the fastener or pinion that ties the link together. In so doing, the present disclosure provides an exceptionally user-friendly and time efficient apparatus for multiple range float capability selection. Moreover, it avoids the expense associated with flexible cable links.

Figure 19:
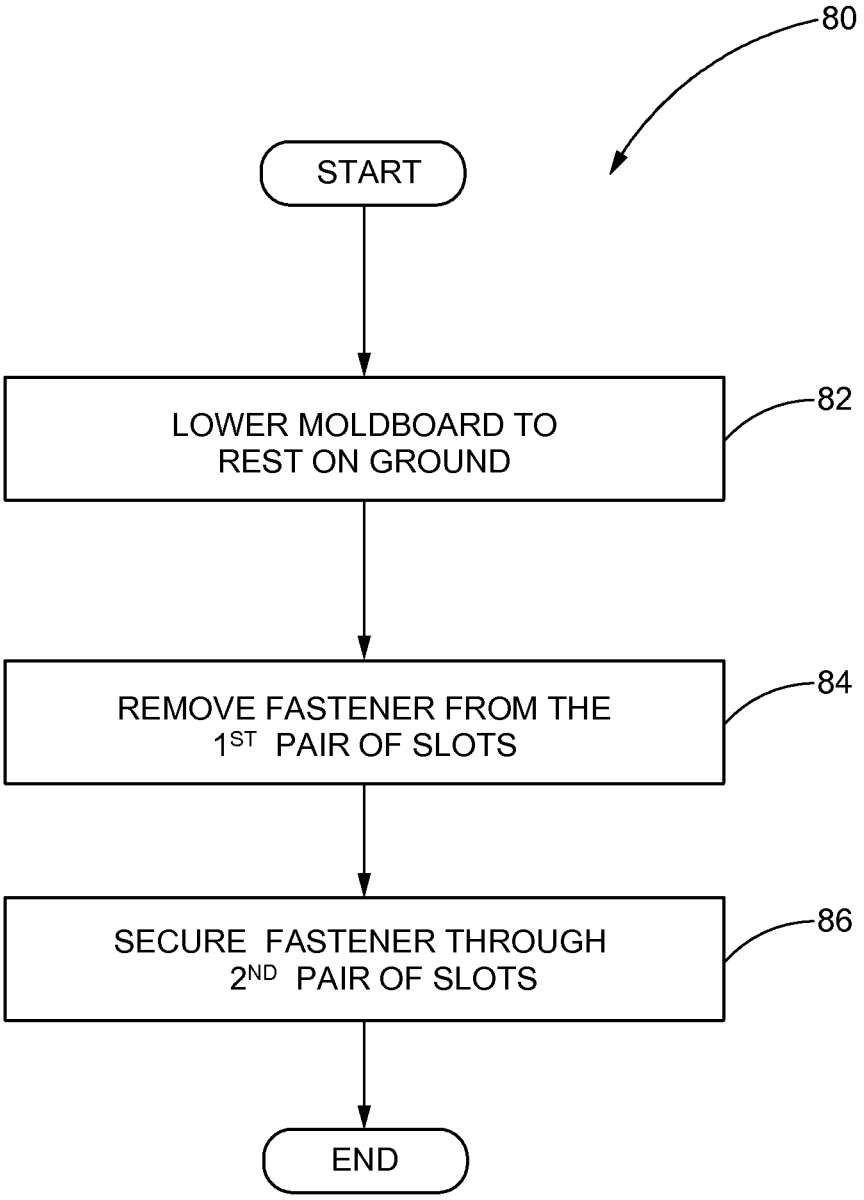
FIG. 19 is a flowchart illustrating a process for adjusting float capability of a moldboard hard linked to a machine according to yet another embodiment.

Turning now to FIG. 19, a flowchart outlining a process 80 for providing multiple float capabilities to a moldboard of a machine is shown, according to another embodiment. At block 82, the moldboard or implement may be lowered to rest on the ground so as to remove any tension within the link which may be present due to the weight of the moldboard or implement. At block 84, the fastener may be removed from the first pair of holes in the outer cylinder and the first pair of slots in the inner cylinder of the link. The fastener may be secured through the second pair of holes in the outer cylinder and through the second pair of slots in the inner cylinder, at block 86. It will be understood that the flowchart in FIG. 19 is shown and described for example purposes only to assist in disclosing the features of the system and that fewer or more steps (such as employing a third or more pair of slots) in a same or different order than that shown may be included in the method 80.

While the foregoing detailed description has been given and provided with respect to certain specific embodiments, it is to be understood that the scope of the disclosure should not be limited to such embodiments, but that the same are provided simply for enablement purposes. The breadth and spirit of the present disclosure are broader than the embodiments specifically disclosed and are limited only by the claims appended hereto. Moreover, while some features are described in conjunction with specific embodiments, these features are not limited to use with only the embodiment with which they are described, but instead may be used together with or separate from, other features disclosed in conjunction with alternate embodiments.

What is claimed is:

1. A hard link connected to a moldboard of a machine, the hard link comprising:

a first range of float capability;

a second range of float capability, the second range of float capability providing a greater float height to the moldboard than the first range of float capability;

a first structure, and a second structure movable relative to the first structure;

a first slot provided in the second structure, the first slot including a length which allows for the first range of float capability; and a second slot provided in the second structure, the second slot including a length which allows for the second range of float capability, the length of the second slot being greater than the length of the first slot.

2. The hard link of claim 1, further comprising a fastener connecting the first and second structures.

3. The hard link of claim 1, further comprising a spring-loaded pin connecting the first and second structures.

4. The hard link of claim 1, wherein the second structure further includes a third slot including a length which allows for a third range of float capability, the length of the third slot being greater than the length of the second slot.

5. The hard link of claim 1, wherein a moldboard float ratio is between an inclusive range of five-to-one (5:1) and eight-to-one (8:1).

6. The hard link of claim 1, wherein the first structure comprises an outer cylinder and the second structure comprises an inner cylinder, the outer and inner cylinders having approximately equal lengths.

7. The hard link of claim 6, wherein the inner cylinder is at least partially disposed within the outer cylinder, and wherein an overlap of the outer cylinder and the inner cylinder is no less than twenty-five percent of an average of the lengths of the outer and inner cylinders.

* * * * *